US005704580A

United States Patent [19]

Peery, Jr.

[11] Patent Number: 5,704,580

[45] Date of Patent: Jan. 6, 1998

[54] REMOVABLE RINGS FOR ASSEMBLING AN ORNAMENTAL BASE TO A STREET POLE

[75] Inventor: Robert H. Peery, Jr., Travis, Tex.

[73] Assignee: Holophane Corporation, Newark, Ohio

[21] Appl. No.: 735,012

[22] Filed: Oct. 22, 1996

[51] Int. Cl.[6] ..... H05K 5/02

[52] U.S. Cl. ..... 248/345; 52/736.4; 362/431

[58] Field of Search ..... 248/159, 519, 248/524, 345; 362/431; 52/721.5, 723.2, 736.4, 737.5

[56] References Cited

U.S. PATENT DOCUMENTS

| | | | |
|---|---|---|---|
| 1,696,934 | 1/1929 | Allen | 52/592 |
| 1,906,508 | 5/1933 | Arbogast | 52/298 |
| 1,939,530 | 12/1933 | Wall | 362/431 |
| 3,974,372 | 8/1976 | Cochran | 362/431 |
| 4,200,906 | 4/1980 | Santilli | 362/431 |

FOREIGN PATENT DOCUMENTS

| | | |
|---|---|---|
| 2690730 | 5/1993 | France . |
| 310648 | 5/1929 | United Kingdom . |

*Primary Examiner*—Ramon O. Ramirez
*Attorney, Agent, or Firm*—Brooks & Kushman

[57] ABSTRACT

A method and apparatus for assembling a selected street pole to a standard sized base is disclosed. The method includes the step of selecting a street pole of a predetermined configuration. Encircling portions, preferably rings consisting of two semi-circular portions, each having a nestable section with each other and a complementary section with the selected street pole are then provided. The encircling portions are nested together on the standard sized base to connect the standard sized base to the selected street pole thereby continuing the appearance finish of the standard sized base while preventing unauthorized access to an interior of the standard sized base. The apparatus includes the encircling portions to connect the standard sized base to the selected street pole.

18 Claims, 3 Drawing Sheets

REMOVABLE RINGS FOR ASSEMBLING AN ORNAMENTAL BASE TO A STREET POLE

TECHNICAL FIELD

The present invention relates generally to pole supports and, more particularly, to ornamental bases for street poles.

BACKGROUND ART

Street poles are used extensively to support equipment such as traffic lights, street lights, etc. Generally, the street poles are mounted to the street through openings in hollow bases. The hollow bases are usually placed on the street at the bottom of the street pole to accommodate electrical equipment associated with the lighting equipment.

Many cities enhance the aesthetics of their streets by providing bases with ornamental designs. Typically it is desirable for all of the street poles in a given area to have the same ornamental base design. A problem for cities trying to maintain their budget while beautifying their streets is that many of the street poles have different sizes, configurations, diameters, circumferences, etc., from one another. Thus, a custom sized base is needed to properly fit each of the street poles. An example of an improper fit between a street pole and a base is when a gap exists between the street pole and the base at the opening of the base. In addition to being aesthetically unappealing, the gap may also allow unauthorized access or provide an inadequate shelter to the electrical equipment housed within the base.

Using differently sized bases increases costs to the city. First, purchasing costs rise because the city is required to buy bases for each street pole size to obtain an inventory of bases before they are needed as replacements. Second, storage costs rise because of the infrastructure required to store a vast assortment of bases. Third, inventory management costs rise because of the necessity to monitor the inventory of bases. This may be a cumbersome task because each base may have to be documented according to an identification number provided on the base. Finally, replacement costs rise because repair personnel will have to initially travel to the site and measure the street pole or locate the identification number on the base to determine what size ornamental base is required. Then the repair personnel will have to return to the warehouse and match the size or identification number with a base in stock. These problems and costs could be reduced if the city had the option to use a few differently sized bases for all of the differently configured street poles instead of using a custom sized base for each street pole.

In an attempt to address this problem, applicant previously constructed a custom sized ring for each base which, when permanently mounted, allowed the modified base to fit a specific size street pole. While this approach decreased the costs associated with maintaining an inventory of differently sized bases, it created an additional problem. Namely, that each modified base only fits a particular size pole. Moreover, since each of the custom rings have different diameters, configurations and sizes, the same inventories previously encountered with different sized bases, resulted. For instance, repair personnel would be required to still measure the size of the pole and return to the warehouse to find the corresponding ring. As in the case of the bases, each ring was also required to be categorized for identification.

Consequently, a need exists for an apparatus and method which allows a selected street pole of a predetermined configuration to be assembled to a standard size base which eliminates the aforementioned inventory and assembly problems.

DISCLOSURE OF THE INVENTION

It is therefore an object of the present invention to provide a standard size base adjustable to properly fit a selected street pole.

It is a further object of the present invention to provide a method of assembling the selected street pole to the standard size base.

It is yet a further object of the present invention to provide a plurality of encircling portions nested together on the standard size base to connect the standard size base to the selected street pole.

It is yet another object of the present invention to provide a plurality of rings nested together on the standard size base and surrounding the selected street pole to connect the standard size base to the selected street pole.

It is still yet a further object of the present invention to substantially reduce costs and lost time associated with replacing ornamental bases for street poles.

In carrying out the above objects and other objects and features of the present invention, a method of assembling a selected street pole from a first inventory of differently configured street poles to a standard sized base having an appearance finish is provided. The method includes the step of selecting a street pole of a predetermined configuration from the first inventory of differently configured street poles. The next step is to provide a second inventory of encircling portions each having a nestable section with each other and a complementary section with the selected street pole. A sufficient number of the encircling portions are nested together on the standard sized base to connect the standard sized base to the selected street pole in a manner in which the complementary section of one of the encircling portions is complementary with at least a portion of the predetermined configuration of the selected street pole.

In accordance with the method of the present invention, an apparatus for assembling a selected street pole of a predetermined configuration to a standard sized base having an appearance finish is also provided. The apparatus includes a plurality of encircling portions each having a nestable section with each other and a complementary section with the selected street pole. The plurality of encircling portions are nested together on the standard sized base to connect the standard sized base to the selected street pole in a manner in which the complementary section of one of the encircling portions is complementary with at least a portion of the predetermined configuration of the selected street pole.

The advantages accruing to the present invention are numerous. For example, the encircling portions will make installation cheaper and easier because standard sized bases will fit any specific sized street pole. The encircling portions will reduce purchasing and storage costs by allowing the city to stock only one sized ornamental base or perhaps just a few differently sized ornamental bases. The encircling portions will provide an aesthetic appearance through a smooth step transition of eliminating the gap between the selected street pole and the standard sized base. The encircling portions will make replacements easier because the repair personnel will always have a base that fits the street pole.

The above objects and other objects, features, and advantages of the present invention will be readily appreciated by one of ordinary skill in the art from the following detailed description of the best modes for carrying out the invention when taken in connection with the accompanying drawings.

BEST MODE FOR CARRYING OUT THE INVENTION

Figure 1:
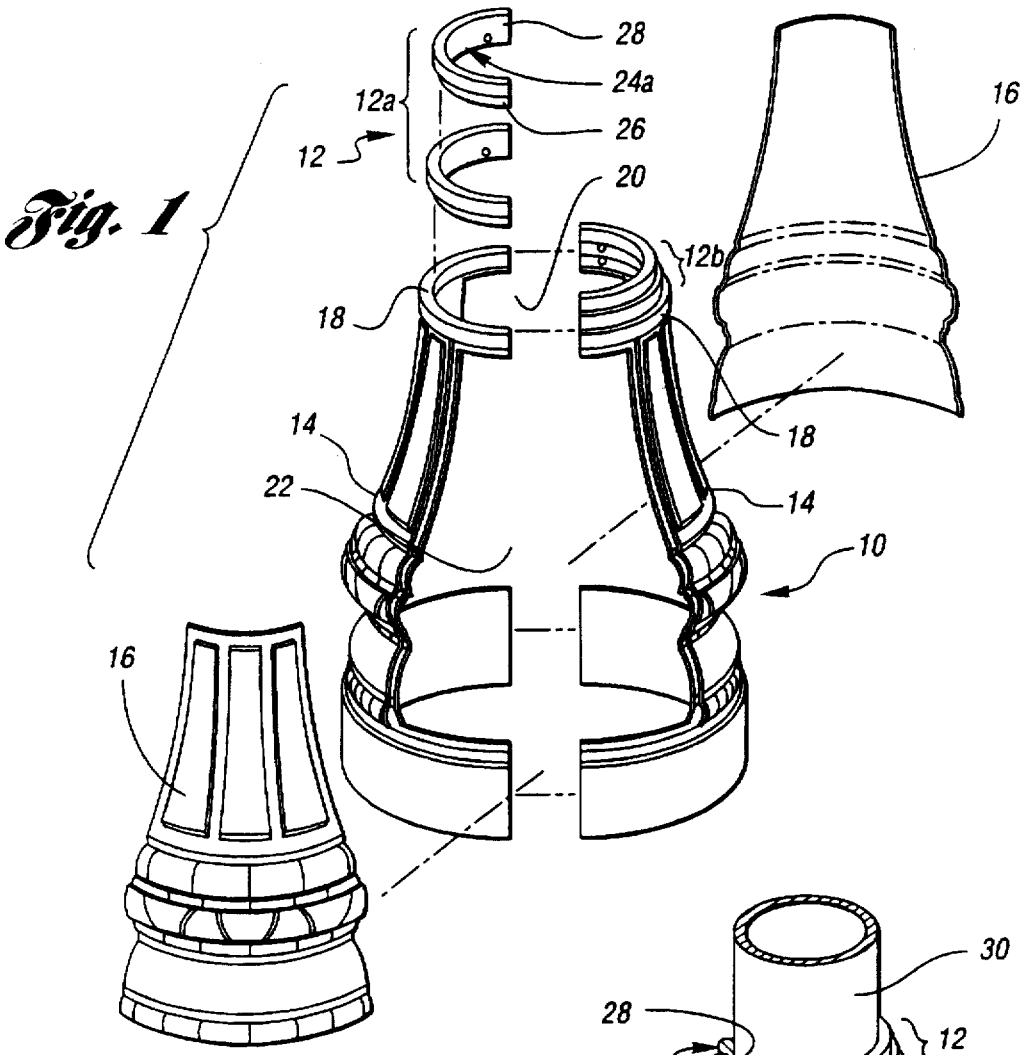
FIG. 1 is an exploded view of a standard sized base having an appearance finish and a plurality of encircling portions in accordance with a preferred embodiment of the present invention.

An exploded view of a standard sized base 10 having an appearance finish and a plurality of encircling portions 12 is illustrated in FIG. 1. In a preferred embodiment, standard sized base 10 consists of two side portions 14 and two door portions 16. Side portions 14 are connected together to form an edge 18 surrounding an opening 20 of standard sized base 10. Side portions 14 define two access openings 22 at least partially defined by edge 18 surrounding opening 20 to allow access to the interior of standard sized base 10. Door portions 16 are mounted to side portions 14 over access openings 22 (not shown in FIG. 1). Opening 20 receives a street pole (not shown in FIG. 1).

Typically, standard sized base 10 is located on the street at the bottom of the street pole to perform the functions of providing a decorative appearance to the street pole and concealing the anchor bolts and wiring access door while sheltering electrical equipment associated with the street pole. As is known in the art, standard sized base 10 consists of at least two or more portions to facilitate installation around the street pole. For instance, many street poles support lighting and signage of various sizes. Obviously, it is impractical to fit a one piece base unit over these obstacles and down the street pole. Furthermore, it is much easier to snap portions of a base together around the street pole near the ground rather than work above the ground. Hence, standard sized base 10 is preferably a clamshell or wrap around base in two or more parts.

As shown in FIG. 1, a plurality of encircling portions 12 preferably consists of two sets of semi-circular portions or half-rings 12*a* and 12*b*. One set of semi-circular portions 12*a* are shown in an exploded view above edge 18 of standard sized base 10. The other set of semi-circular portions 12*b* are shown stacked on edge 18 of standard sized base 10. Only two semi-circular portions are shown in one set for simplicity, but, of course, a set may consist of more than two semi-circular portions. Each of the semi-circular portions in sets 12*a* and 12*b* are of graduated size and can be stacked together, with each semi-circular portion fitting within the immediately larger.

Each one of the semi-circular portions in one set 12*a* has a corresponding semi-circular portion in the other set 12*b*. The corresponding semi-circular portions may be placed together to form a ring. For example, semi-circular portion 24*a* and corresponding semi-circular portion 24*b* may be placed together to form a ring.

Each one of plurality of encircling portions 12 has a nestable section 26 and a complementary section 28. For simplicity, nestable section 26 and complementary section 28 are shown only for encircling portion 24*a*. As will be described in detail below, encircling portions 12 are nested together on edge 18 of standard sized base 10 to match opening 20 to a street pole for properly fitting the street pole to standard sized base 10.

Figure 2:
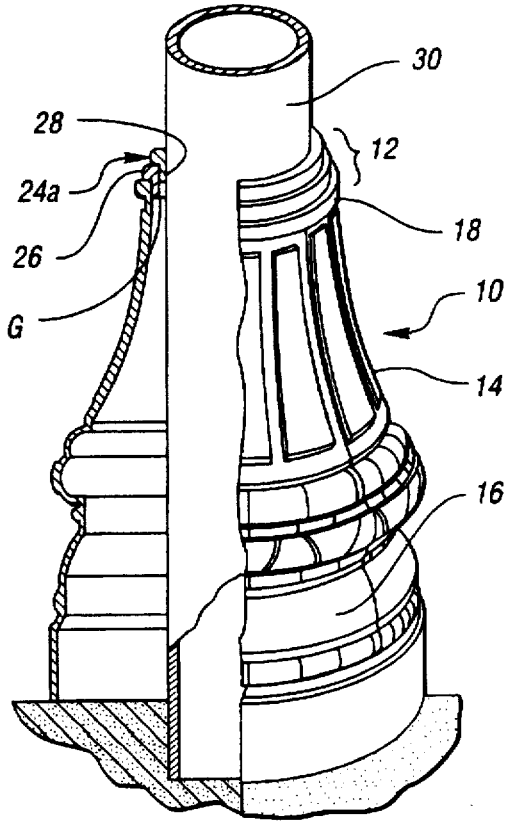
FIG. 2 is a perspective cut away view showing the plurality of encircling portions connecting the standard sized base to the street pole.

The manner in which encircling portions 12 properly fit standard sized base 10 to a street pole may be understood in further detail by referring now to FIG. 2. As shown in FIG. 2, standard sized base 10 and plurality of encircling portions 12 enclose a portion of a street pole 30. Street pole 30 is selected from a first inventory of differently configured street poles. Street pole 30 may have a smooth cylindrical surface as shown in FIG. 2. Of course, street pole 30 may have a cross-sectional area in the shape of a square, rectangular, octagonal, or the like. The primary advantage of the present invention is that standard sized base 10 may be properly fitted to street poles of any configuration by using encircling portions 12. The only requirement needed for standard sized base 10 to properly fit a variety of street poles is that opening 20 of standard sized base 10 is large enough to accommodate the chosen street pole.

As shown in FIG. 2, a gap (G) between edge 18 of standard sized base 10 and street pole 30 exists. Gap (G) is indicative of an improper fit between street pole 30 and standard sized base 10. Standard sized base 10 is improperly fitted to street pole 30 because the circumference of opening 20 formed by edge 18 is larger than the circumference of street pole 30. Hence, standard sized base 10 is not snugly fitted to street pole 30 at opening 20. Gap (G) will allow unauthorized access and provide an inadequate shelter to the electrical equipment housed within the ornamental base.

A feature of the present invention is to provide encircling portions 12 to connect, or snugly fit, standard sized base 10 to street pole 30 in order to effectively eliminate gap (G) and its detrimental consequences. Encircling portions 12 each have nestable section 26 with each other and complementary section 28. Nestable section 26 allows encircling portions 12, each of graduated size, to be stacked together on top of each other with each encircling portion fitting within the immediately larger. Hence, as encircling portions 12 are nested together on edge 18 of standard sized base 10, the size of opening 20 is effectively reduced.

Complementary section 28 is in the form of a portion of the surface of street pole 30. For instance, if street pole 30 is a cylinder then complementary section 28 is in the form of a portion of a cylindrical surface. A sufficient number of encircling portions 12 are nested together on edge 18 until complementary section 28 of one of the encircling portions, for example, encircling portion 24*a*, is complementary with at least a portion of the predetermined configuration of street pole 30. Once complementary section 28 of encircling portion 24*a* is complementary with street pole 30, standard sized base 10 is connected to street pole 30 and gap (G) is effectively eliminated.

Hence, nesting a sufficient number of encircling portions 12 together on standard sized base 10 to connect standard sized base 10 to street pole 30 continues the appearance finish of standard sized base 10. Furthermore, the sufficient number of encircling portions 12 nested together on standard sized base 10 prevents unauthorized access to the interior of standard sized base 10.

Figure 3C:
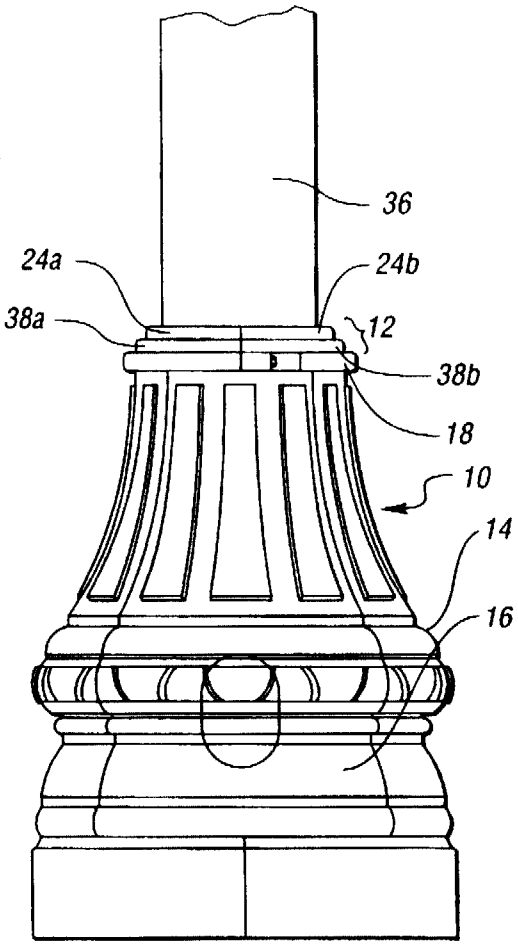
FIGS. 3*a*, 3*b*, and 3*c* illustrate a different number of encircling portions being utilized to properly fit the standard sized base to differently sized street poles.
Figure 3B:
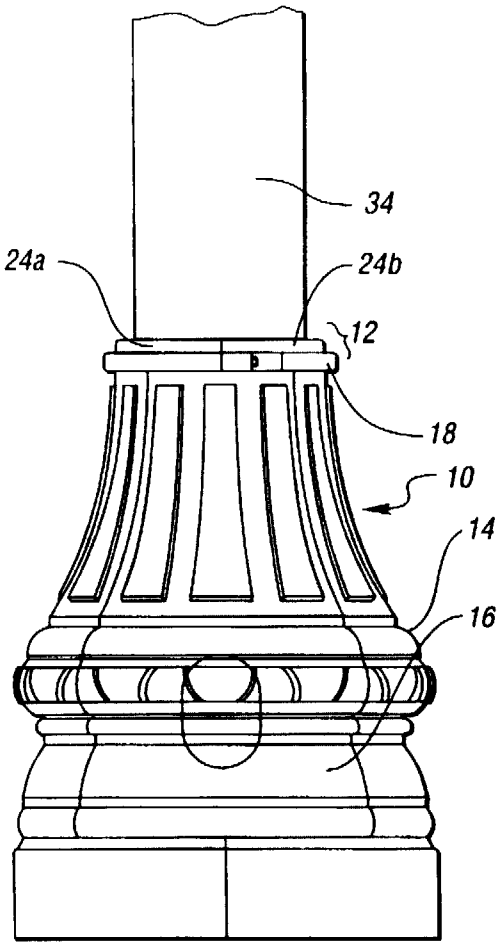
Figure 3A:
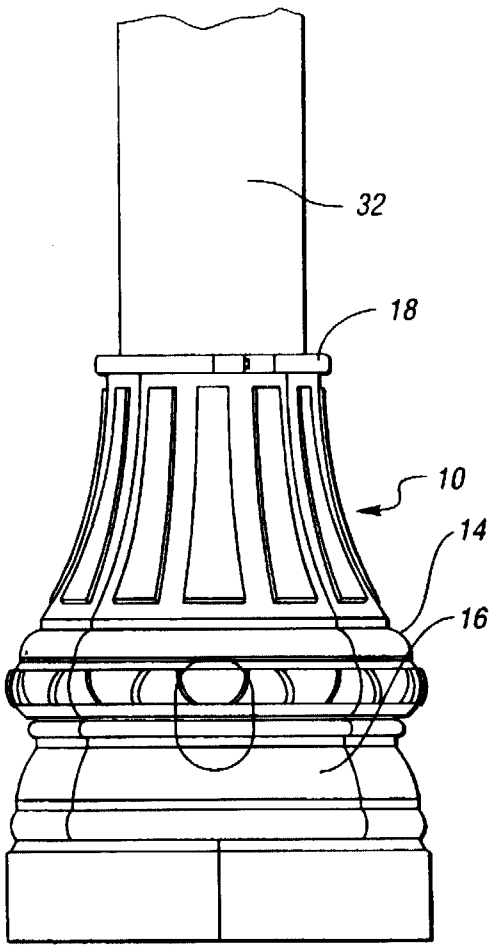

Referring now to FIGS. 3*a*, 3*b*, and 3*c*, the number of encircling portions 12 chosen to fit standard sized base 10 to a street pole depends on the difference in size between opening 20 of standard sized base 10 and the street pole. For instance, as shown in FIG. 3*a*, standard sized base 10 properly fits a street pole 32 without the use of encircling portions 12. In this case there is no difference in size and standard sized base 10 happens to be custom-sized to fit street pole 32. An advantage of the present invention is that this "custom-sized" standard sized base 10 may be adjusted with the use of encircling portions 12 to fit other street poles of different sizes.

As shown in FIG. 3*b*, standard sized base 10 is adjusted to properly fit a street pole 34 with the use of semi-circular portions 24*a* and 24*b*. Street pole 34 in FIG. 3*b* has a smaller circumference than street pole 32 in FIG. 3*a*. Semi-circular portions 24*a* and 24*b* are stacked on edge 18 to effectively eliminate the difference in size between standard sized base 10 and street pole 34.

Depending on the difference in size between standard sized base 10 and a street pole, more than one pair of encircling portions 12 may be needed to properly fit standard sized base 10 to the street pole. As shown in FIG. 3*c*, a street pole 36 has a smaller circumference than street pole 34. Hence, semi-circular portions 38*a* and 38*b* are stacked on edge 18. Since complementary section 28 of semi-circular portions 38*a* and 38*b* are not complementary with street pole 36, there is still a gap between standard sized base 10 and street pole 36. The gap between standard sized base 10 and street pole 36 is eliminated when semi-circular portions 24*a* and 24*b* are stacked on semi-circular portions 38*a* and 38*b*. At this point, complementary section 28 of semi-circular portions 24*a* and 24*b* are complementary with street pole 36.

Figure 4:
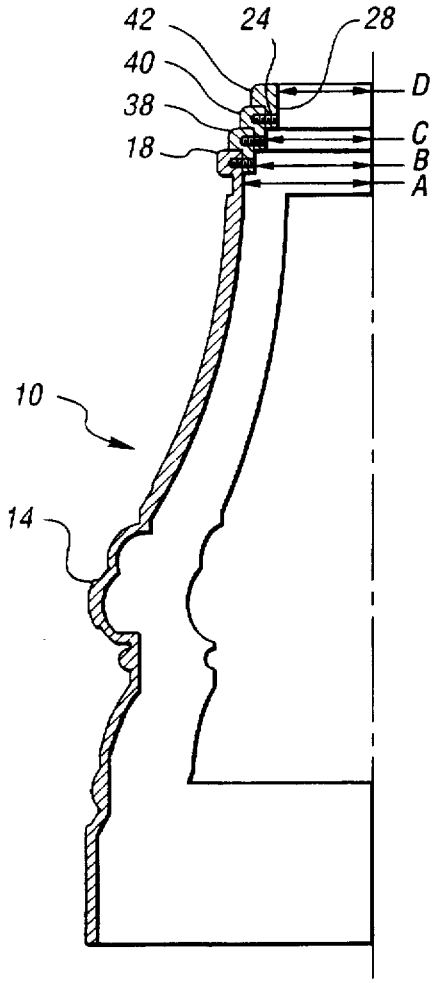
FIG. 4 is a sectional side view illustrating the plurality of encircling portions being nested together on the standard sized base.

Referring now to FIG. 4, a sectional side view illustrating encircling portions 12 being nested together on edge 18 of standard sized base 10 is shown. The sectional side view clearly illustrates how the size of the opening that receives the street pole may be adjusted.

For example, the radius of the opening formed by edge 18 is length "A". Stacking an encircling portion 38 on edge 18 reduces the radius of the opening from length "A" to length "B". Stacking an encircling portion 40 on encircling portion 38 reduces the radius of the opening further from length "B" to length "C". Finally, stacking encircling portion 24 on encircling portion 40 reduces the radius of the opening to length "D". Thus, as long as the complementary section of the encircling portions are complementary with the street pole, standard sized base 10 will properly fit a street pole having a radius of length "A", "B", "C", or "D".

In a preferred embodiment, encircling portions are secured to each other by set screws. For example, encircling portion 24 is secured to encircling portion 40 with a set screw 42.

Figure 5:
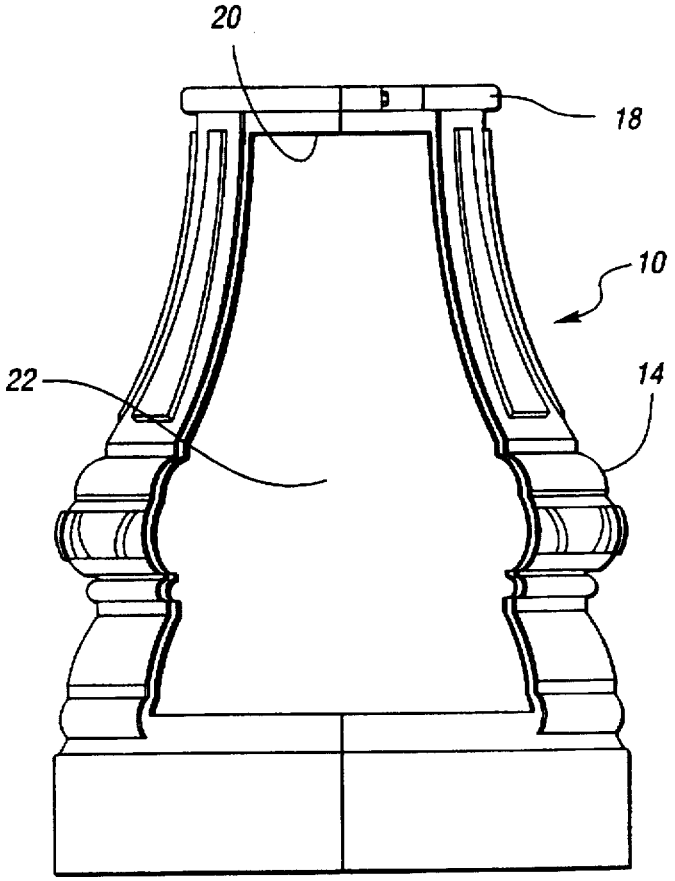
FIG. 5 illustrates an assembled view of the standard sized base without door pieces.

Referring now to FIG. 5, an assembled view of standard sized base 10 without door pieces 16 is shown. Door pieces 16 are connected together to form edge 18 surrounding opening 20 of standard sized base 10. Door pieces 16 have access opening 22 at least partially defined by edge 18 surrounding opening 20 of standard sized base 10 to allow access to the interior of standard sized base 10.

It is to be understood, of course, that while the forms of the present invention described above constitute the preferred embodiments of the present invention, the preceding description is not intended to illustrate all possible forms thereof. It is also to be understood that the words used are words of limitation, and that various changes may be made without departing from the spirit and scope of the present invention, which should be construed according to the following claims.

What is claimed is:

1. A method of assembling a selected street pole from a first inventory of differently configured street poles to a standard size base having an appearance finish, the method comprising the steps of:

selecting a street pole of a predetermined configuration from the first inventory of differently configured street poles;

providing a second inventory of encircling portions each having a nestable section with each other and a complementary section with the selected street pole; and nesting a sufficient number of the encircling portions together on the standard size base to connect the standard size base to the selected street pole in a manner in which the complementary section of one of the encircling portions is complementary with at least a portion of the predetermined configuration of the selected street pole.

2. The method of claim 1 wherein the step of nesting a sufficient number of the encircling portions together on the standard size base to connect the standard size base to the selected street pole continues the appearance finish of the standard sized base.

3. The method of claim 1 wherein the step of nesting a sufficient number of the encircling portions together on the standard size base to connect the standard size base to the selected street pole prevents unauthorized access to the interior of the standard size base.

4. The method of claim 1 wherein each one of the encircling portions are semi-circular.

5. The method of claim 1 wherein each one of the sufficient number of the encircling portions surround the selected street pole.

6. The method of claim 1 wherein the complementary sections of at least some of the encircling portions meet the predetermined configuration of the selected street pole.

7. An apparatus for assembling a selected street pole of a predetermined configuration to a standard size base having an appearance finish, the apparatus comprising:

a plurality of encircling portions each having a nestable section with each other and a complementary section with the selected street pole, the plurality of encircling portions are nested together on the standard size base to connect the standard size base to the selected street pole in a manner in which the complementary section of one of the encircling portions meets at least a portion of the predetermined configuration of the selected street pole.

8. The apparatus of claim 7 wherein the plurality of encircling portions are nested together on the standard size base to connect the standard sized base to the selected street pole for continuing the appearance finish of the standard size base.

9. The apparatus of claim 7 wherein the plurality of encircling portions are nested together on the standard size base to connect the standard sized base to the selected street pole for preventing unauthorized access to the interior of the standard sized base.

10. The apparatus of claim 7 wherein each one of the plurality of encircling portions are semi-circular.

11. The apparatus of claim 7 wherein each one of the plurality of encircling portions surround the selected street pole.

12. The apparatus of claim 7 wherein each one of the plurality of encircling portions are rings.

13. The apparatus of claim 12 wherein each ring consists of two semi-circular portions.

14. The apparatus of claim 7 wherein the complementary section of at least some of the plurality of encircling portions are completely complementary with the predetermined configuration of the selected street pole.

15. An adjustable housing for properly fitting a street pole, the adjustable housing comprising:

a hollow base having an ornamental finish and an opening for receiving the street pole, the hollow base having an edge surrounding the opening; and a plurality of rings each having a nestable section with each other and a complementary section with the street pole, the plurality of rings are nested together on the edge surrounding the opening of the hollow base to connect the hollow base to the street pole in a manner in which the complementary section of one of the rings meets the street pole thereby continuing the ornamental finish of the hollow base.

16. The adjustable housing of claim 15 wherein the hollow base includes at least two side portions connected together to form the edge surrounding the opening of the hollow base.

17. The adjustable housing of claim 16 wherein the at least two side portions have an access opening at least partially defined by the edge surrounding the opening of the hollow base to allow access to an interior of the hollow base.

18. The adjustable housing of claim 15 wherein each one of the plurality of rings consists of two semi-circular portions.

* * * * *